United States Patent [19]

Maki

[11] Patent Number: 4,536,681

[45] Date of Patent: Aug. 20, 1985

[54] TEMPERATURE COMPENSATED TIME EXPOSURE CONTROL CIRCUIT

[75] Inventor: Farrel M. Maki, Fridley, Minn.

[73] Assignee: Minnesota Mining and Manufacturing Company, St. Paul, Minn.

[21] Appl. No.: 515,297

[22] Filed: Jul. 19, 1983

[51] Int. Cl.[3] ..... H05B 39/04

[52] U.S. Cl. ..... 315/309; 355/14 E; 355/30

[58] Field of Search ..... 355/30, 83, 67, 69, 355/14 E, 107, 12; 307/141, 141.4, 117, 310, 591; 315/291, 309; 331/65, 66; 361/170, 181, 203

[56] References Cited

U.S. PATENT DOCUMENTS 3,826,569 7/1974 Sakamaki ..... 355/30

FOREIGN PATENT DOCUMENTS 197803 3/1978 Canada ..... 355/30

*Primary Examiner*—A. T. Grimley
*Assistant Examiner*—C. Romano
*Attorney, Agent, or Firm*—Donald M. Sell; James A. Smith; Robert L. Marben

[57] ABSTRACT

A temperature compensated control circuit in an electrophotographic copy machine having a machine "ready" portion for presenting a machine ready condition and with which an intermediate copy sheet is used for exposure to the output of a light source including a time adjustable control circuit portion providing a time period during which the light source is energized. The time adjustable control circuit portion has a temperature sensitive element for shortening the time period as the temperature within the machine increases and for lengthening the time period as the temperature within the machine decreases. Such automatic temperature adjustment compensates the exposure time versus temperature relationship of the intermediate sheet.

6 Claims, 2 Drawing Figures

TEMPERATURE COMPENSATED TIME EXPOSURE CONTROL CIRCUIT

BACKGROUND OF THE INVENTION

The invention presented herein relates to electrophotographic copy machines having an adjustable time exposure control circuit and, in particular, to such copy machines wherein the exposure control circuit automatically reduces the exposure time when the temperature within the copy machine increases.

Electrophotographic copy machines are available which use an intermediate sheet to which light from a light source is directed while the original to be copied is in face-to-face contact with the intermediate sheet. The original and intermediate sheet combination is placed on a platen. The platen, as well as the machine interior, increases in temperature when a number of copies are made in a short period of time. The intermediate sheet is temperature sensitive such that the exposure time required to obtain a copy of a given quality decreases with an increase in the temperature to which the intermediate sheet is subjected. In prior copiers of this type, the exposure time is manually selected so that a "dial chasing" problem is presented in the operation of such copiers due to changes in the temperature within the copy machine.

SUMMARY OF THE INVENTION

The present invention minimizes the "dial chasing" problem presented by the timed exposure control used in prior electrophotographic copy machines of the type just described. The invention presented herein provides an electrophotographic copy machine that has a machine "ready" circuit portion for presenting a machine "ready" condition and is one with which an intermediate copy sheet is used for exposure to the output of a light source within the machine. The copy machine includes a time adjustable control circuit portion that is operatively connected to the machine "ready" circuit portion and to the light source. The time adjustable control circuit portion is operative after the machine "ready" circuit portion presents a "ready" condition to provide a timed period during which the light source is energized. The time adjustable control circuit portion includes a temperature sensitive element positioned within the copy machine for shortening the time period when the temperature within the copy machine increases and for lengthening the time period as the temperture within the machine decreases.

The machine "ready" circuit portion includes a temperature responsive switch which presents a machine "ready" condition with a switch means operatively connected to the temperature responsive switch and the time adjustable control circuit portion serving to present a machine "ready" condition to the time adjustable control circuit portion when the temperature response switch presents a "ready" condition. In addition, a perceptible indicator, such as a light source, is operatively connected to the switch means serving to provide a perceptible indication to an operator when the temperature responsive switch presents a machine "ready" condition.

The time adjustable control circuit portion is provided with a manually operable switch means which is connected to the machine "ready" circuit portion and also with a timing circuit portion which has an input to which a signal is applied to initiate operation of the timing circuit portion to establish the start of a time period with an output provided by the timing circuit portion at which a signal is produced signifying the end of the time period. The timing circuit portion also includes a time period selection means for selection of the length of the time period with such time period selection means including the temperature sensitive element positioned within the copy machine. The time adjustable control circuit portion also includes a switching means that is operatively connected to the manually operable switch means plus the input and output of the timing circuit portion as well as the light source. The switching means initiates the operation of the light source and provides a signal to the input of the timing circuit portion to initiate operation of the timing circuit portion when the manually operable switch means is operated after the machine "ready" circuit portion has presented a machine "ready"condition. The switching means also terminates operation of the light source when the signal produced at the end of the time period is presented at the output of the timing circuit portion. The timing circuit portion includes an oscillator that is operatively connected to the time period selection means. The time period selection means includes an adjustable resistive portion plus the temperature sensitive element which can be a capacitor having a negative temperature coefficient. The switching means of the time adjustable control circuit portion includes a flip-flop circuit which is operatively connected to the manually operable switch means as well as the input and output of the timing circuit portion. The switching means of the time adjustable control circuit portion also includes a relay which is operatively connected to the flip-flop with the relay having relay switch contacts that control operation of the light source.

BRIEF DESCRIPTION OF THE DRAWING

The invention presented herein will be best understood by reference to the following description taken in connection with the accompanying drawing wherein.

DETAILED DESCRIPTION

Figure 1:
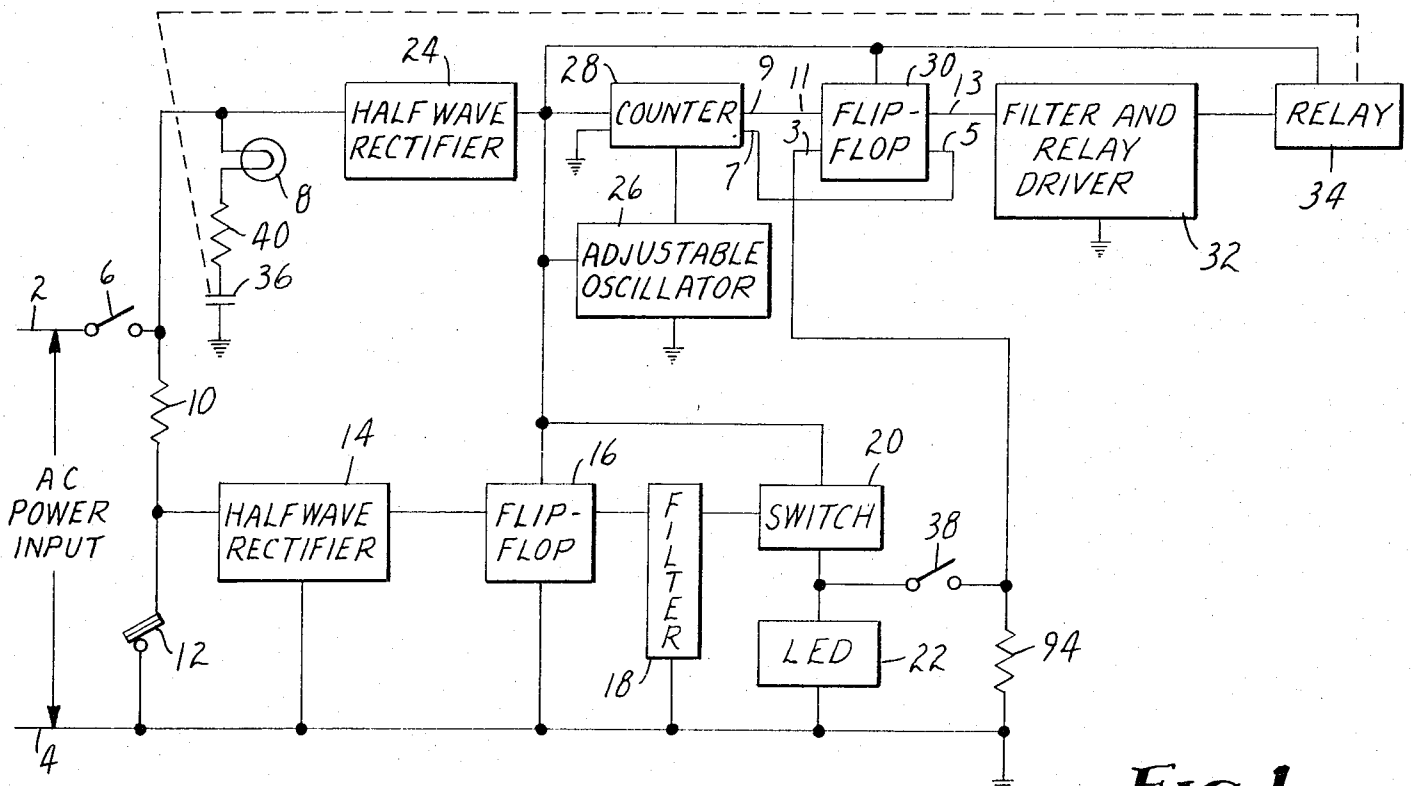
FIG. 1 is a schematic in block diagram form showing circuitry for an electrophotographic copy machine which embodies the invention.

The invention presented herein is applicable to electrophotographic copy machines which utilize an intermediate copy sheet that is exposed to the output of a light source in the machine. Such electrophotographic copy machines have a heated roll that is used in the copy process which must first be brought up to temperature before the intermediate sheet can be exposed to the light source while an original copy is placed in face-to-face contact with the intermediate sheet. Referring to FIG. 1 of the drawing, circuitry is shown which is powered from an A.C. source that is applied between conductors 2 and 4. The conductor 2 is connected via a manually operated power switch 6 to the remainder of the circuitry. A light source 8 used in the copy machine may be one or more incandescent lamps as shown at 8. The heating element for the heated roll used in the electrophotographic copy machine is shown at 10 and is connected between the switch 6 and conductor 4 via a thermostatic switch 12. A machine "ready" circuit portion is provided which in FIG. 1 includes the half-way rectifier 14, flip-flop circuit 16, filter 18, switch 20 and a perceptible indicator 22, which may be a light emitting diode (LED) as shown. The machine "ready" circuit portion serves to provide the operator with a perceptible indication when the copy machine is ready for operation to produce a copy. The circuitry in FIG. 1 also includes a time adjustable control circuit portion whose connections are to the machine "ready" circuit portion and to the light source 8. The time adjustable control circuit portion of FIG. 1 includes a half-way rectifier 24, adjustable oscillator 26, a counter 28, flip-flop circuit 30, a filter and delay driver circuit 32 and a relay 34 having a relay contact 36 plus a manually operated switch 38. The time adjustable control circuit portion can be operated when the machine "ready" circuit portion presents a "ready" condition and serves to provide a time period during which the light source 8 is energized. The light source 8 is connected to the switch 6 and also to ground. The connection to ground is made via a resistor 40 connected in series with relay contact 36. The resistor 40 is provided to protect the light source 8 from a current surge when the relay contacts 36 are initially closed.

When the heated roll (not shown) for the copy machine has been heated to the desired temperature via the heating element 10, the thermostatic switch 12 opens. The half-way rectifier 14 can then function and provides an input to the flip-flop circuit 16 causing it to provide an output that is applied to switch 20 via a filter 18 to cause switch 20 to operate to energize the LED 22. Filter 18 is utilized merely to remove any noise signals from the circuit so that switch 20 is not operated other than from the desired output from the flip-flop circuit 16. With the light emitting diode 22 operating, the time adjustable control circuit portion is operable and is placed in operation by the manual operation of switch 38. When the switch 38 is closed, a signal is developed across a resistor 94 and is applied to the input 3 of flip-flop circuit 30 to cause the output 13 of flip-flop 30 to provide for the operation of the filter and relay driver circuit 32 for energization of lamp 8 via operation of the contacts 36 of relay 34. At the same time, an output signal is presented at the output 5 of the flip-flop circuit 30 which is applied to the input 7 of counter 28 causing the counter 28 to be reset and begin a count of the signals received by the counter from the adjustable oscillator 26. After the lapse of a period of time, which is dependent upon the frequency of the oscillator 26, a count is reached causing an output signal to be presented at the output 9 of the counter 28 which is applied to the input 11 of flip-flop circuit 30 causing the output at output 13 to change so that the filter and relay driver 32 are no longer operable to energize the relay 34. As a result, the relay contacts 36 open and the lamp 38 is de-energized.

While not shown in FIG. 1, the adjustable oscillator 26 includes time period selection means that has a temperature sensitive element positioned within the copy machine which is effective to increase the frequency of operation of the oscillator 26 and thereby shorten the time period provided for operation of the lamp 8 as the temperature within the copy machine increases. Similarly, such time period is increased when the temperature within the copy machine decreases.

Figure 2:
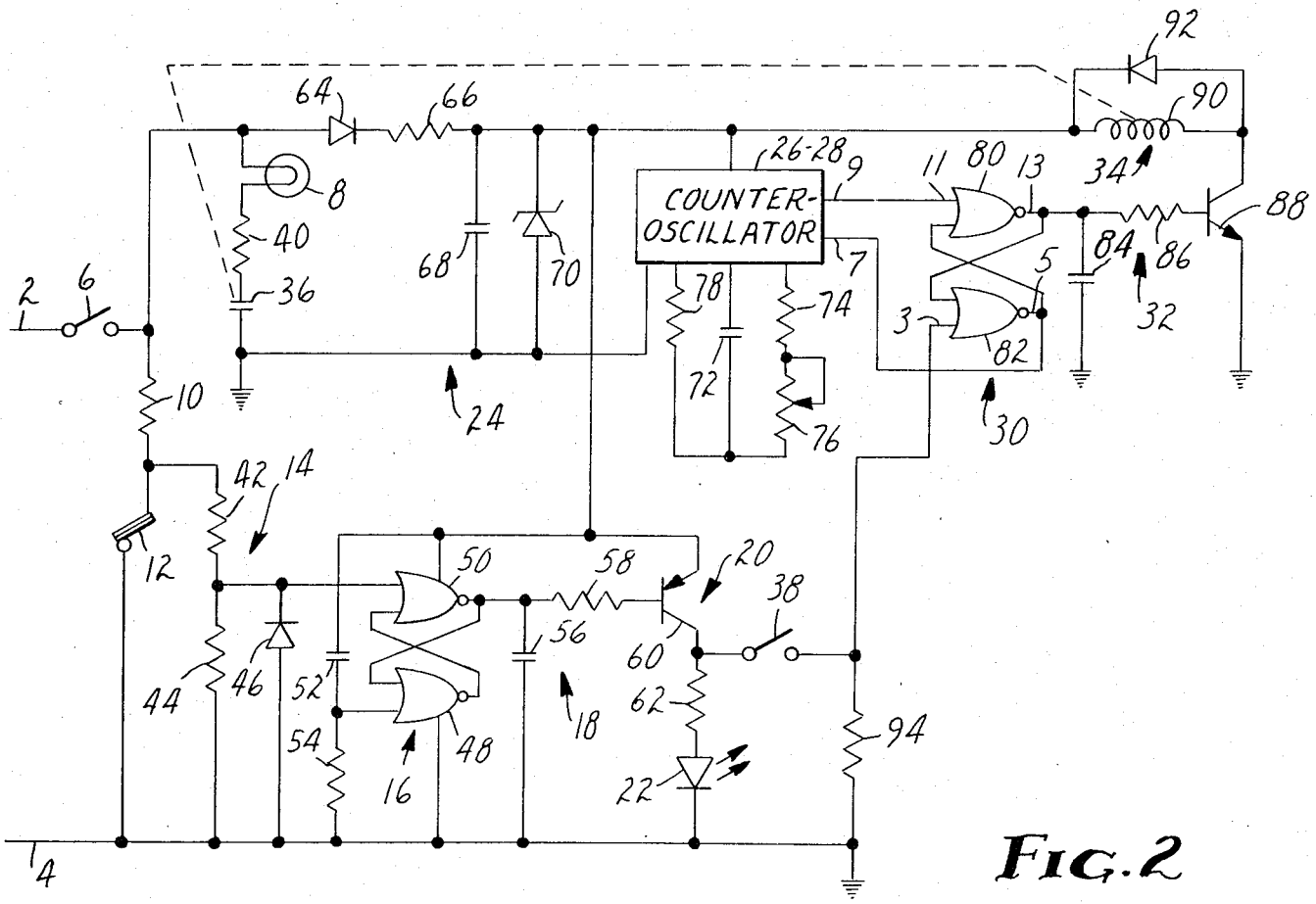
FIG. 2 is a schematic showing in accordance with FIG. 1 with exemplary circuits shown for those portions indicated in block form in FIG. 1.

FIG. 2 of the drawing is the same as FIG. 1, except that various exemplary circuits are shown for the various portions of FIG. 1 that are shown in block form. Where applicable, the reference numerals used in FIG. 1 are also used in FIG. 2 to identify the same circuit portions or elements. The half-wave rectifier 14 includes series connected resistors 42 and 44 plus a diode 46 which is connected in parallel with resistor 44. The series connected resistors 42 and 44 are connected across the thermostatic switch 12 and serve as a voltage divider for the half-wave rectifier 14. The flip-flop circuits 16 and 30 are formed from NOR circuits since several NOR circuits can be placed on a single semiconductor circuit chip to provide the flip-flops. Accordingly, it should be noted that only one connection is shown for each of the flip-flops 16 and 30 for purposes of establishing a ground connection and a connection to the DC power that is provided by the half-wave rectifier 24. Such power and ground connection is common to the two flip-flops 16 and 30. The flip-flops 16 and 30 are RS (reset-set) flip-flop circuits, each using two NOR gates. The flip-flop 16 has NOR circuits 48 and 50 with the set input for the flip-flop provided at the NOR gate 50 and is connected to the half-wave rectifier 14 at the connection common to the resistors 42 and 44. A capacitor 52 and resistor 54 are connected in series between the output of the half-wave rectifier 24 and the ground conductor 4 with the connection common to the capacitor 52 and resistor 54 connected to the reset input of the flip-flop 16 which is provided at the NOR gate 48. This arrangement provides for resetting of the flip-flop 16 when power is initially applied to the circuitry of FIG. 2 via the switch 6. The filter 18 is connected to the output of NOR circuit 50 and is provided by resistor 58 and capacitor 56. The switch 20 is provided by a PNP type transistor and resistor 62.

When the switch 6 is initially closed and assuming the thermostatic switch 12 is closed, which will normally be the case, the set input at NOR gate 50 for the flip-flop 16 will receive a "0" input so that the output of the NOR gate 50 will be high causing the transistor 60 to be turned off. When the thermostatic switch 12 opens, a voltage is applied to the set input of the flip-flop 16 causing the output of NOR gate 50 to go low allowing the transistor 60 to conduct which in turn energizes the LED 22.

Referring to the timing circuit portion of the time adjustable control circuit portion, the half-wave rectifier 24 is provided by the diode 64 with a resistor 66 and capacitor 68 connected to smooth out the half-wave output from the diode 64. In addition, a Zener diode 70 is connected in parallel with the capacitor 68 to provide a desired level of DC output from the half-wave rectifier 24. The output of the half-wave rectifier 24 serves to provide the desired DC voltage for the flip-flop 16, transistor 60, counter-oscillator 26, 28, flip-flop 30 and relay 34. The adjustable oscillator 26 and the counter 28 of FIG. 1 is indicated by a single block labeled counter-oscillator identified with the reference numerals 26, 28 plus a time period selection means that is provided by capacitor 72, resistor 74 and potentiometer 76. Another resistor 78 is shown which provides a feedback function for the semiconductor circuit selected to provide the counter-oscillator 26, 28. Such a semiconductor circuit is available under the type designation 4060 from the National Semiconductor Corporation, 2900 Semiconductor Drive, Santa Ana, Calif. 95051. The time period selection means serves to establish the frequency of operation of the oscillator. The capacitor 72 is one which has a negative temperature coefficient so the frequency of the oscillator is increased as the temperature within the copy machine increases and vice versa. An increase in the frequency of the oscillator decreases the time period set by the adjustment made to the potentiometer 76. With this automatic correction of the time period with respect to temperature, the exposure time provided for a intermediate sheet is automatically reduced making it possible to provide copies of a consistent quality.

The flip-flop circuit 30 is provided by two NOR gates 80 and 82. The NOR gate 80 provides the input 11 which is connected to the output 9 of the oscillator-counter. The input 11 is the reset input for the flip-flop circuit 30. The set input for the flip-flop circuit 30 is provided by the input 3 of the NOR gate 82 which has its output 5 connected to the input 7 of the counter-oscillator. The output 13 of the NOR gate 80 is connected to the filter and relay driver circuitry 32.

The filter portion of the filter and relay driver circuit 32 is provided by a capacitor 84 and resistor 86. The driver portion is provided by an NPN type transistor 88, which has its base electrode connected to the output of NOR gate 80 via the resistor 86, its emitter electrode connected to ground and its collector electrode connected to the winding 90 of the relay 34. Since the relay 34 is DC operated, a diode 92 is connected in parallel with the winding 90 so that the contacts 36 for the relay 34 will not tend to open during negative half cycles of the AC power.

Reviewing the operation of the time adjustable control circuit portion of FIG. 2, the operator of the copy machine will close switch 38 after the LED 22 is turned on indicating that the machine is ready for purposes of having copies made. Upon closure of switch 38, a voltage is produced across the resistor 94 and is applied to the set input 3 of the flip-flop 30 causing the output of the NOR gate 82 to reset the counter in the oscillator-counter circuit 26, 28 to begin the time period determined by the setting of a potentiometer 76. In addition, the output of NOR gate 80 of the flip-flop circuit 30 changes from a logic "0" to a logic "1" causing the transistor 88 to be turned on to energize the relay 34 closing contacts 36 to cause the lamp 8 to be energized. Upon completion of the time period, the counter-oscillator presents a signal at its output 9 to reset the flip-flop circuit 30 causing the output of the NOR gate 80 to again present a logic "0" to cause the transistor 88 to be turned off thereby de-energizing the relay 34 to cause contacts 36 to open to terminate operation of the lamp 8.

While only a single embodiment has been illustrated and described, it will be apparent to those skilled in the art that various modifications and improvements may be made without departing from the scope and spirit of the invention. For example, while the capacitor 72 has been described as providing the desired temperature compensation, resistor 74 could be used instead of capacitor 72 by selecting a resistor that has a negative temperature coefficient. Accordingly, it is to be understood that the invention is not to be limited by the illustrative embodiment, but only by the scope of the appended claims.

I claim:

1. Control circuitry usable with a machine "ready" circuit portion for controlling the output of a light source including:

a time adjustable control circuit portion operatively connected to the machine "ready" circuit portion and to the light source, said time control circuit portion operable after the machine "ready" circuit portion presents a machine "ready" condition for providing a timed period during which the light source is energized, said time adjustable control circuit portion including a temperature sensitive element for shortening said timed period as the temperature sensed by said temperature sensitive element increases and lengthening said timed period as the temperature sensed decreases.

2. Control circuitry according to claim 1 wherein the machine "ready" circuit portion includes:

a temperature responsive switch for presenting a machine "ready" condition; and first switch means operatively connected to said temperature responsive switch and said time adjustable control circuit portion for presenting a machine "ready" condition to said time adjustable control circuit portion after said temperature responsive switch presents a machine "ready" condition.

3. Control circuitry according to claim 2 wherein the machine "ready" circuit portion includes:

a perceptible indicator operatively connected to said first switch means for providing a perceptible indication when said temperature responsive switch presents a machine "ready" condition.

4. Control circuitry according to claim 1 wherein the time adjustable control circuit portion includes:

a manually operable switch means connected to the machine "ready" circuit portion;

a timing circuit portion having an input for receiving a signal to initiate operation of said timing circuit portion establishing the start of said time period and an output at which a signal is produced subsequent to initiation of the operation of said timing circuit portion establishing the end of said time period, said timing circuit portion including a time period selection means for selection of the length of said time period, said timing period selection means including said temperature sensitive element; and said time adjustable control circuit portion also including a second switch means operatively connected to said manually operable switch means, said input and output of said timing circuit portion and the light source, said second switch means initiating the operation of the light source plus providing a signal to said input of said timing circuit portion to initiate operation of said timing circuit portion in response to the operation of said manually operable switch means provided the machine "ready" circuit portion presents a machine "ready" condition and terminating operation of the light source in response to production of a signal at said output of said timing circuit portion at the end of said time period.

5. Control circuitry according to claim 4 wherein said timing circuit portion includes an oscillator operatively connected to said time period selection means, said time period selection means including an adjustable resistive portion operatively connected to said temperature sensitive element which is a capacitor having a negative temperature coefficient.

6. Control circuitry according to claim 4 wherein said second switch means includes a flip-flop circuit operatively connected to said manually operable switch means and said input and output of said timing circuit portion and a relay operatively connected to said flip-flop, said relay having relay switch contacts operatively connected to the light source.

* * * * *

UNITED STATES PATENT AND TRADEMARK OFFICE

CERTIFICATE OF CORRECTION

PATENT NO. : 4,536,681

DATED : August 20, 1985

INVENTOR(S) : FARREL M. MAKI

It is certified that error appears in the above-identified patent and that said Letters Patent is hereby corrected as shown below:

Column 3, lines 8-9, delete "whose connections are" and insert -- that is connected --.

Signed and Sealed this

*Thirty-first* Day of *December 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,536,681

DATED : August 20, 1985

INVENTOR(S) : Farrel M. Maki

It is certified that error appears in the above-identified patent and that said Letters Patent is hereby corrected as shown below:

Column 4, line 16, "connection is" should read -- connection are --.

Signed and Sealed this

*Fourth* Day of *February 1986*

[SEAL]

*Attest:*

*Attesting Officer*

DONALD J. QUIGG

*Commissioner of Patents and Trademarks*